US006464151B1

(12) United States Patent
Cordua

(10) Patent No.: US 6,464,151 B1
(45) Date of Patent: Oct. 15, 2002

(54) FLOW VOLUME ADJUSTMENT DEVICE FOR IRRIGATION SPRINKLER HEADS

(76) Inventor: Paul M. Cordua, P.O. Box 929, Lindsay, CA (US) 93247

( * ) Notice: Subject to any disclaimer, the term of this patent is extended or adjusted under 35 U.S.C. 154(b) by 0 days.

(21) Appl. No.: 09/840,010

(22) Filed: Apr. 19, 2001

(51) Int. Cl.[7] ..... B05B 1/32

(52) U.S. Cl. ..... 239/457; 239/514; 239/DIG. 1

(58) Field of Search ..... 239/451, 456–458, 239/460, 200, 201, 511–514, 581.1, 581.2, DIG. 1

(56) References Cited

U.S. PATENT DOCUMENTS

| | | | |
|---|---|---|---|
| 1,417,031 | A | 5/1922 | Casorso et al. |
| 2,321,031 | A | 6/1943 | Lateur |
| 2,935,266 | A | 5/1960 | Coleondro et al. |
| 3,362,641 | A | 1/1968 | Barnes |
| 3,815,832 | A | 6/1974 | Floyd |
| 4,079,762 | A | 3/1978 | Hanson, Jr. |
| 4,119,275 | A | 10/1978 | Hunter |
| 4,154,404 | A | 5/1979 | Clawson |
| 4,184,239 | A | 1/1980 | Clawson |
| 4,189,099 | A | 2/1980 | Bruninga |
| 4,579,285 | A | 4/1986 | Hunter |
| D296,464 | S | 6/1988 | Marmol et al. |
| 5,083,709 | A | 1/1992 | Iwanowski |
| 5,148,990 | A | 9/1992 | Kah, Jr. |
| 5,205,491 | A | 4/1993 | Hadar |
| 5,360,167 | A | 11/1994 | Grundy et al. |
| 5,556,036 | A | 9/1996 | Chase |
| 6,019,295 | A | 2/2000 | McKenzie |
| 6,145,758 | A | 11/2000 | Ogi et al. |

*Primary Examiner*—Lisa A. Douglas
(74) *Attorney, Agent, or Firm*—Fulwider Patton Lee & Utecht, LLP

(57) ABSTRACT

The adjustable arc spray nozzle allows adjustment of the spray arc, the radius, and flow of the water spray provided by the nozzle. The nozzle includes a top member, a base member, and a discharge orifice defined therebetween. A rotatable external upper collar controls the radius of the pattern, an internal helix member controls the arc of the spray pattern, and an internal flow adjustment screw and an optional rotatable external lower collar control the flow of the nozzle.

28 Claims, 7 Drawing Sheets

FIG. 12
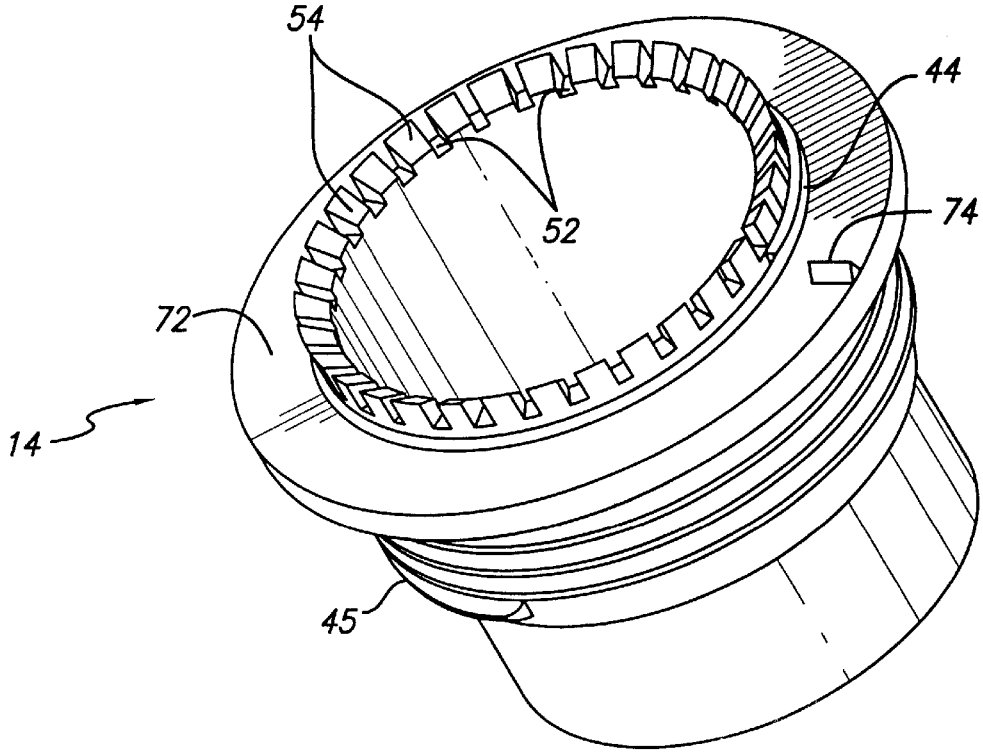
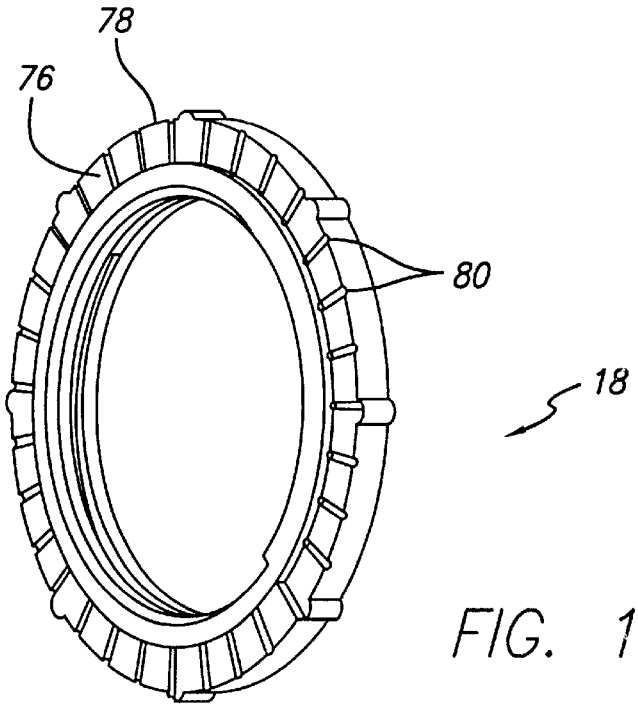
FIG. 13

FIG. 14
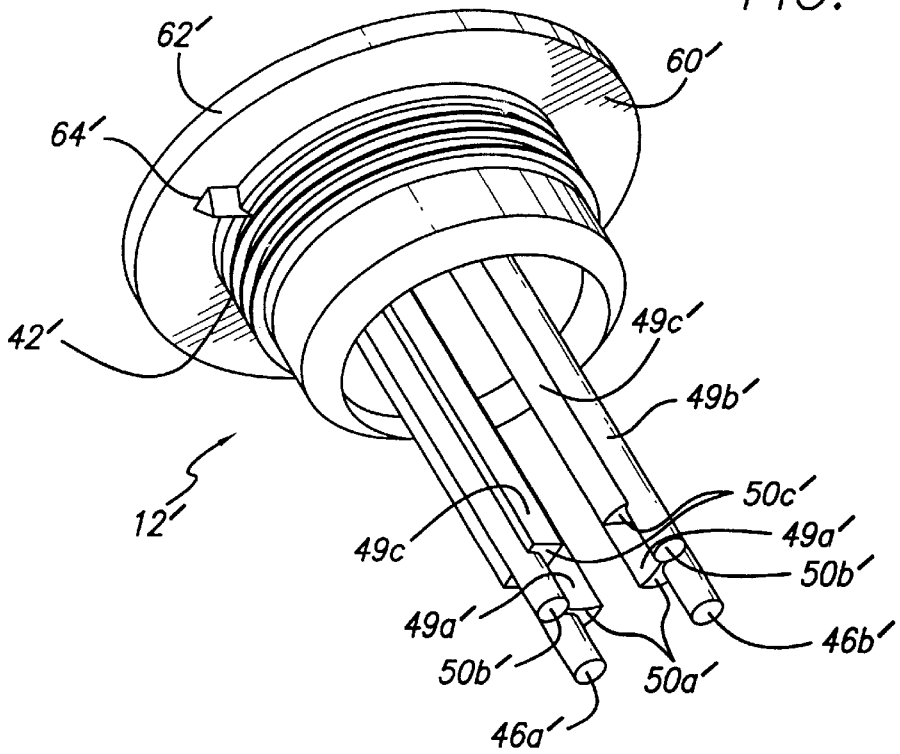
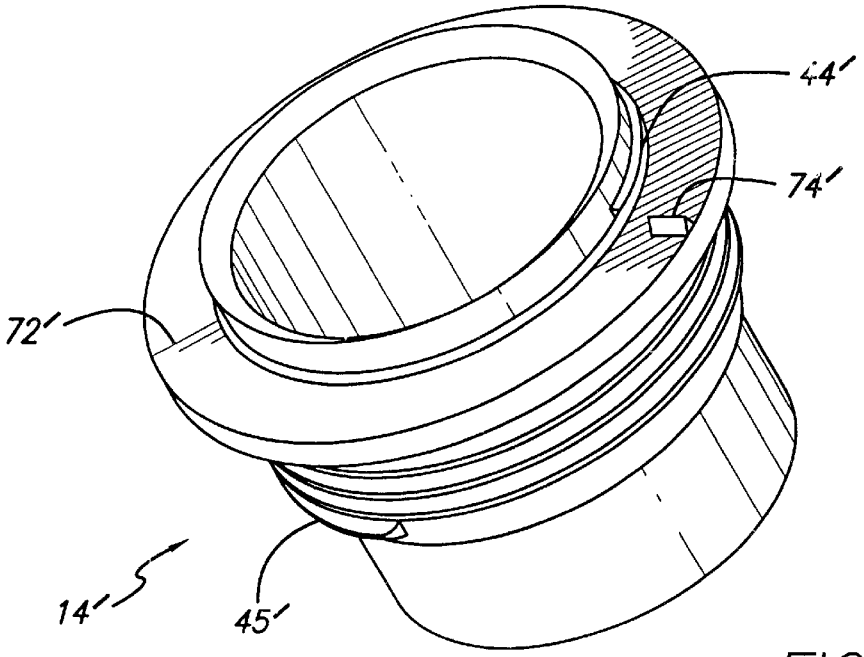
FIG. 15

FLOW VOLUME ADJUSTMENT DEVICE FOR IRRIGATION SPRINKLER HEADS

BACKGROUND OF THE INVENTION

This invention relates generally to water sprinklers, and more particularly concerns an adjustable spray arc nozzle providing for adjustment of the spray arc, the radius, and flow of the water spray provided by the nozzle.

The irrigation industry commonly uses stationary fixed spray arc nozzles with pop-up spray heads for irrigation of lawns and gardens. There are currently more than thirty patterns provided to achieve the necessary arcs and diameters for various applications. While adjustable arc nozzles also have been introduced that provide various spray arc diameters to achieve a customized water spray pattern with an adjustable arcuate width, the distribution of water from such variable arc spray nozzles is typically uneven as the angle of spray is adjusted. In conventional double helix nozzle designs, the orifice outlet also typically is not in a flat plane, and the spray pattern of water continues to climb as the arc is moved toward a full 360 degrees. One attempt to overcome these problems has been to provide a splash plate at the discharge orifice of the nozzle to provide for a redirection and mixing of the discharged water, with various modifications of the splash plate allowing the effect of the splash plate on the water spray to be varied. However, it would be desirable to provide an improved adjustable arc nozzle allowing for a more comprehensive and uniform adjustment of the spray arc, the radius, and flow of the water spray provided by the adjustable arc nozzle. The present invention meets these needs.

SUMMARY OF THE INVENTION

Briefly, and in general terms, the present invention provides for an improved adjustable arc nozzle providing for adjustment of the spray arc, the radius, and flow of the water spray provided by the nozzle. The adjustable arc nozzle advantageously provides for a lateral discharge from the discharge orifice at a preset trajectory, commencing from a level plane. The discharge of the water from the discharge orifice on the discharge plane where the top member meets the base member is controlled in part by an internal single helix member.

The present invention accordingly provides for an adjustable arc spray nozzle connectable with a source of pressurized fluid for providing a spray pattern radially disposed about the nozzle. The nozzle includes a top member and a base member connected to the top member, with a discharge orifice formed in a discharge plane between the top member and the base member. A rotatable external upper collar is preferably provided for controlling the radius of the pattern, and a rotatable external lower collar may be provided on the base member for controlling the flow of the nozzle. The nozzle advantageously includes an internal helix member for controlling the arc of the spray pattern of the nozzle. The top member includes a plurality of elongated pegs extending axially from the top member, and the internal helix member includes a plurality of apertures for receiving the plurality of pegs of the top member such that the internal helix member located does not rotate with respect to the top member and the base member. The internal helix member has a helically configured surface extending about the circumference of the internal helix member, so that as the internal helix member is moved downwardly the arc of the spray pattern of the nozzle increases, and as the internal helix member is moved upwardly the arc of the spray pattern of the nozzle decreases.

In a presently preferred aspect of the internal helix member, the internal helix member has a plurality of incremental steps extending about the circumference of the upper helical surface of the internal helix member. Thus, as the internal helix member is moved downwardly each incremental step a corresponding slot between the top member and the base member is opened, and as the internal helix member is moved upwardly each incremental step a corresponding slot between the top member and the base member is closed, to control the arc of the spray pattern of the nozzle.

An internal flow adjustment screw is also provided for controlling the flow of the nozzle proportional to the arc of the spray pattern of the nozzle. The internal flow adjustment screw is threaded axially through the internal helix member between the top member and base member, so that upon rotation of the internal flow adjustment screw the internal helix member moves axially in the internal portion of the assembly to control the flow of water through the discharge orifice of the nozzle proportional to the arc of the spray pattern of the nozzle. In another presently preferred aspect, the internal flow adjustment screw has an upper end with a flange received in a corresponding slot in the top member, and the internal flow adjustment screw has a bottom end captured in the base member, such that the internal flow adjustment screw controls the size of the discharge orifice when the top member and the base member are assembled.

In one presently preferred embodiment, the top member includes a plurality of elongated pegs, which extend through corresponding apertures in the internal helix member and through corresponding apertures in the base member, to connect the top member and the base member. In a presently preferred aspect, the top member and the base member also have surfaces together defining a plurality of mating slots at the discharge plane. In another presently preferred aspect, the pegs include stepped sections having flanges which also serve to regulate flow through the corresponding apertures in the internal helix member as the internal helix member is moved axially. In another preferred aspect, one of the pegs has a configuration that matches a corresponding aperture in the internal helix member, for ease of assembly of the nozzle.

In another presently preferred aspect, the external upper collar has a bottom side with a splash plate portion that is slightly above the discharge plane, so that the splash plate interferes with the discharge plane, causing a breakup action of the discharge of water from the discharge orifice. In another presently preferred aspect, the radius of the pattern can be reduced by downward movement of the external upper collar, and the radius of the pattern can be increased by upward movement of the external upper collar. In another presently preferred aspect, the lower surface of an upper portion of the top member includes a detent which engages a helical surface on an upper lip portion of the external upper collar. The helical surface on the upper lip portion of the external upper collar also preferably has a plurality of grooves permitting periodic location of the detent of the top member, thereby effecting a ratchet type action and holding the upper collar in position after being set.

In a preferred aspect, an optional external lower collar is provided on the base member, and the external lower collar can be rotated moving in an upward direction that will cover the discharge of the discharge orifice or slot thereby controlling the amount water to be discharged. In another presently preferred aspect, an upper surface of the base member includes a detent which engages a helical surface on a lower lip portion of the external lower collar. The helical surface on the lower lip of the external lower collar preferably has a plurality of grooves permitting periodic location of the detent of the base member, thereby effecting a ratchet type action and holding the external lower collar in position after being set.

These and other aspects and advantages of the invention will become apparent from the following detailed description and the accompanying drawings, which illustrate by way of example the features of the invention.

BRIEF DESCRIPTION OF THE DRAWINGS

FIG. 12 is a top perspective view of the base member of the improved adjustable arc spray nozzle of FIG. 1;

FIG. 13 is a bottom perspective view of the external lower collar of the improved adjustable arc spray nozzle of FIG. 1;

FIG. 14 is a bottom perspective view of an alternate top member for the improved adjustable arc spray nozzle of FIG. 1; and FIG. 15 is a top perspective view of an alternate base member for the improved adjustable arc spray nozzle of FIG. 1.

DETAILED DESCRIPTION OF THE PREFERRED EMBODIMENTS

Figure 4:
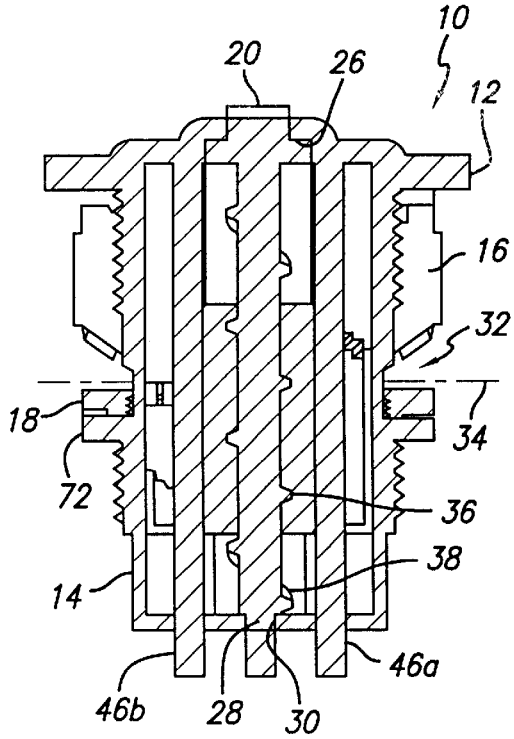
FIG. 4 is a sectional view of the improved adjustable arc spray nozzle taken along line 4—4 of FIG. 3.
Figure 3:
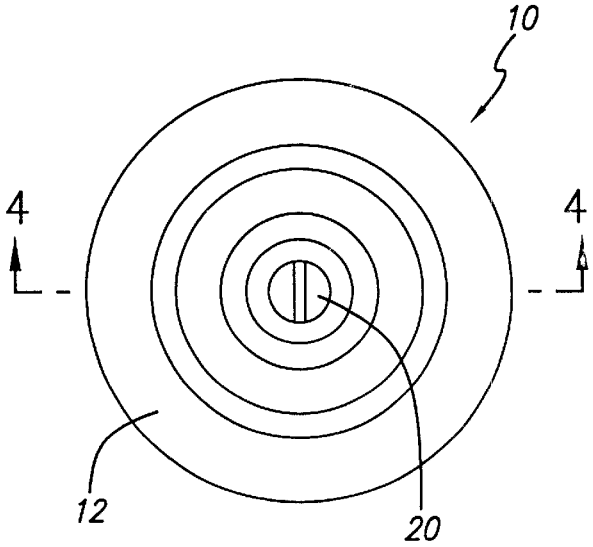
FIG. 3 is a top view of the improved adjustable arc spray nozzle of FIG. 1.
Figure 5:
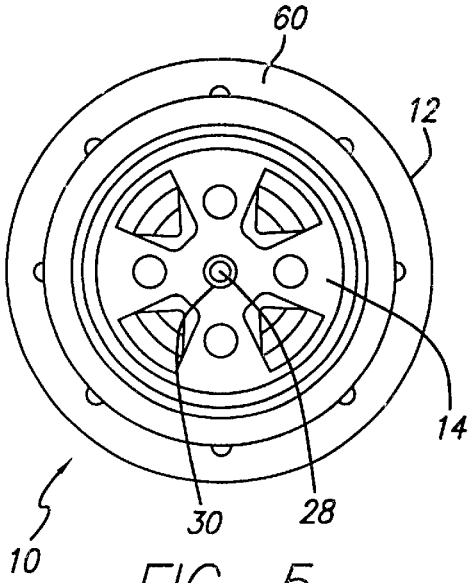
FIG. 5 is a bottom view of the improved adjustable arc spray nozzle of FIG. 1.

The present invention provides for an improved adjustable arc spray nozzle that allows for adjustment of the spray arc, the radius, and flow of the water spray provided by the nozzle. As is illustrated in the drawings, the adjustable arc nozzle 10 is assembled from a top member 12, a base member 14, an external upper collar 16, an optional external lower collar 18, and an internal flow adjustment screw 20 extending axially about an axis 21 through an internal helix member 22 between the top member and base member. The internal flow adjustment screw principally allows for control of flow from the nozzle governed by up and down vertical movement of the internal flow adjustment screw proportional to the arc of the spray pattern, but also serves as a device to assure a proper discharge "gap" or orifice size, when the top and base are assembled. This is accomplished by a flange 24 (shown in FIGS. 4 and 6) on the upper end of the screw. The flange mounts on the upper inside edge 26 of the top (shown in FIG. 4), and the bottom 28 of the screw is placed on the inside bottom 30 of the base in a captured position, determining the exact height dimension between the top and base where the discharge orifice 32 is located on the discharge plane 34.

Figure 1:
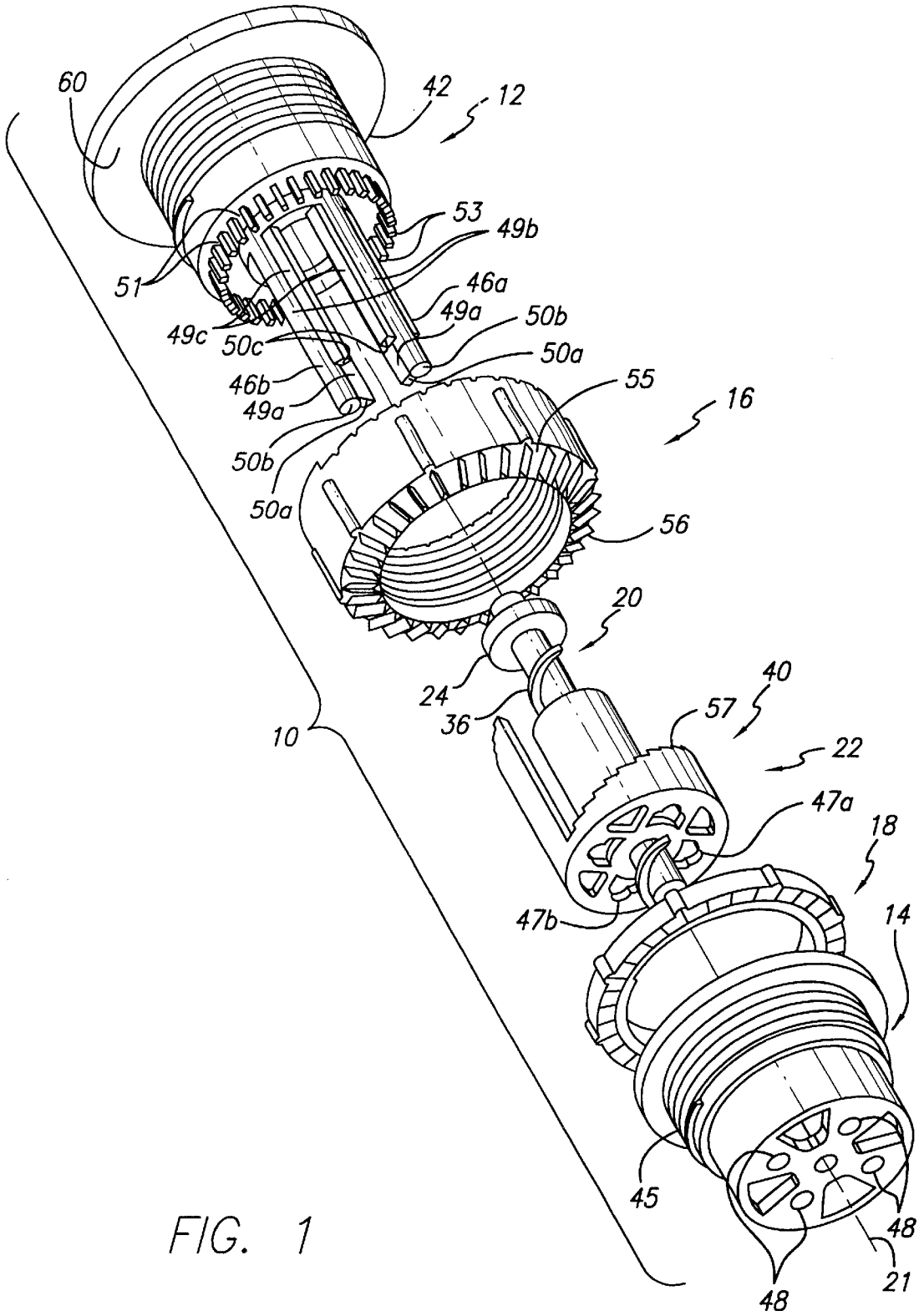
FIG. 1 is an exploded perspective view of the improved adjustable arc spray nozzle according to the invention.

With reference to FIGS. 1, 4, 6 and 11, the internal flow adjustment screw has an external thread 36 that is screwed into a corresponding internally threaded channel 38 of the helix to form a helix assembly 40. The helix assembly is inserted into the top member, the external upper collar is screwed onto the threaded outer portion 42 of the top member, the lower collar is screwed onto the threaded upper outer portion 44 of the base member, and the base assembly is fitted to the top assembly. The base member also has an outer threaded portion 45 for connecting to a water supply (not shown). The top member and base member assemblies are attached by way of a plurality of elongated pegs 46*a,b* attached to the top member and protruding axially through apertures 47*a,b* in the internal helix member and apertures 48 in the base member, and the plurality of pegs may be secured to the base member by heat staking or other similar methods, in order to hold the final assembly together. Referring to FIG. 7, the pegs 46*a,b* includes a plurality of foreshortened, stepped sections 49*a,b,c* having flanges 50*a, b,c,* which also serve to regulate flow through the corresponding apertures in the internal helix member as the internal helix member is moved axially. Preferably at least one of the pegs 46*a* has a configuration that matches a corresponding aperture 47*a* in the internal helix member, such as the upper squared configuration at 49*c* of peg 46*a* and the corresponding aperture 47*a* having a matching squared configuration, for ease of assembly of the nozzle, as is best seen in FIGS. 1, 7 and 10B.

As is best seen in FIGS. 1, 4, 6, 7 and 12, at the discharge plane 34 where the top member and base member meet there are mating slots 51, 52 that are defined by projections or teeth 53, 54 on the top member and base member, respectively, to form a rectangular, round, oval, sawtooth or any other form of an orifice, but not limited to a particular orifice form, and also can be a horizontal slot, or a horizontal slot with sawtooth or other forms, not letting the top member or the base member touch one another at this plane. This area forms the discharge orifice 32 of the nozzle. By using various forms of an orifice or slot, different patterns of water can be achieved. The angle of discharge from the orifice plane can vary as well. As is illustrated in FIGS. 14 and 15, in which like reference numbers denote like elements, the top member 12' and base member 14' can be optionally formed so as not to define individual slots, but rather to define a horizontal slot generally.

Figure 2:
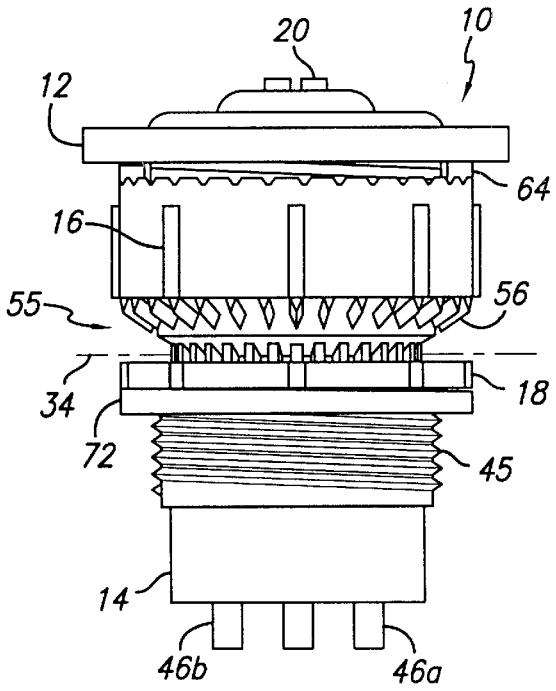
FIG. 2 is a side elevational view of the improved adjustable arc spray nozzle of FIG. 1.
Figure 8:
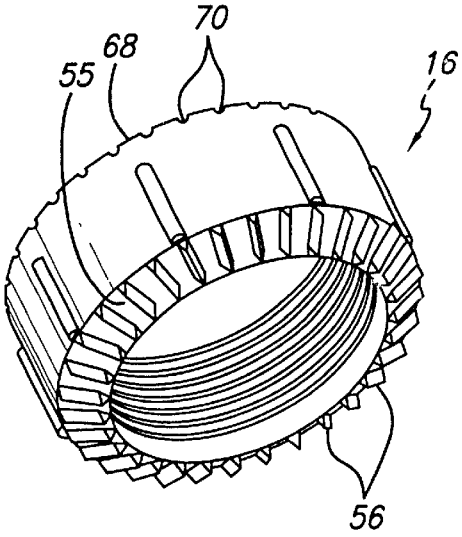
FIG. 8 is a bottom perspective view of the external upper collar of the improved adjustable arc spray nozzle of FIG. 1.

Referring to FIGS. 1, 2 and 8, the external upper collar has an angle or splash plate portion 55, typically formed with regularly spaced projections or teeth 56 on the bottom side of the external upper collar, that is located slightly above the discharge plane. By rotating the external upper collar, the external upper collar moves in a downward direction axially along the top member, and the splash plate starts to interfere with the discharge water plane, causing a breakup action of the discharge water from the orifice. This action will result in the radius being reduced, as the external upper collar continues in the downward movement, the radius can be reduced or if moved back in the upward direction increases to the maximum radius, any position in between can set the radius to the desired radius. The design of the external upper collar splash plate 55 can be of various angles, multiple angles, sharp grooves, radius grooves, sawtooth or rounded to control the discharge stream or fan like spray from a slot of the orifice. If a horizontal slot is used, the splash plate can change the pattern by using a sawtooth splash plate, or ribbed splash plate, a multiple angled splash plate or other forms, thereby effecting the discharge pattern to achieve an even pattern or any other pattern desired. For example, a "donut" pattern or a pattern with a heavy distribution of water on the inner area and a light distribution of water on the outer area of the pattern may be provided.

The external lower collar 18 can be rotated moving in an upward direction that will cover the discharge of the discharge orifice or slot 32 thereby controlling the amount water to be discharged. This can operate from full open to fully closed, or any position in between a fully open or fully closed arc of the spray pattern.

Figure 6:
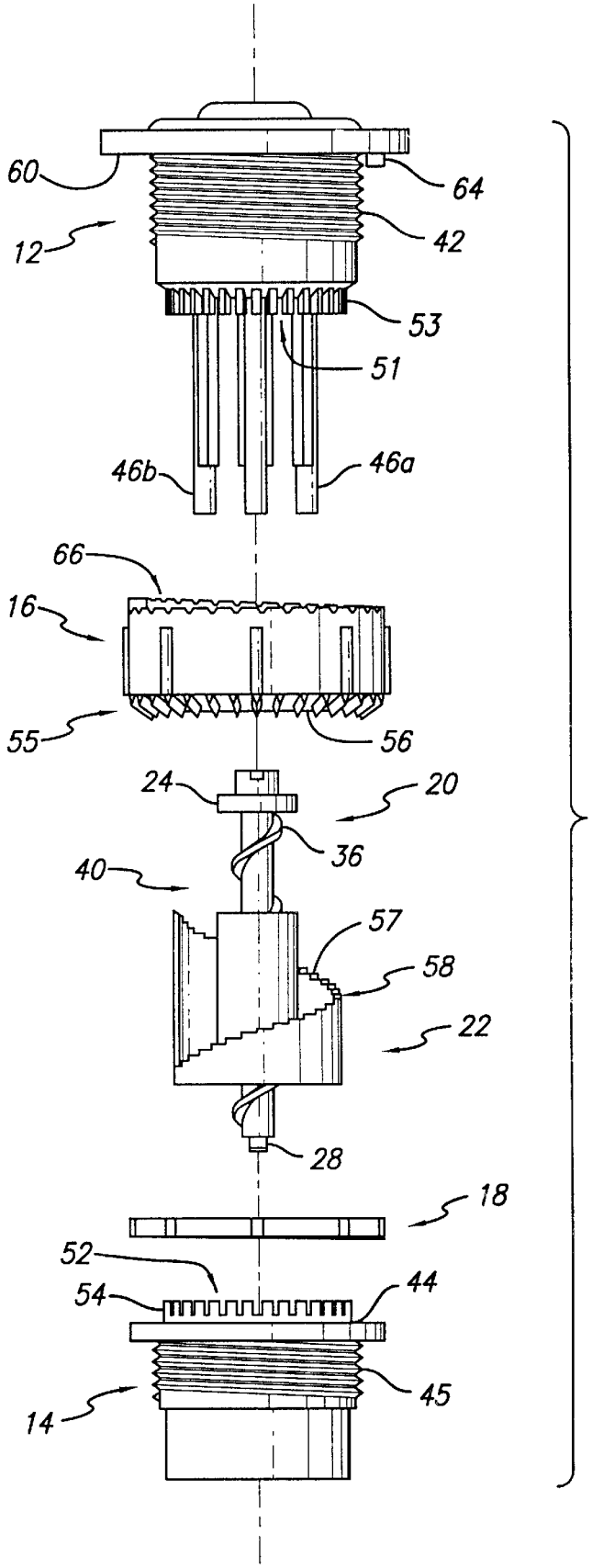
FIG. 6 is an exploded side view of the improved adjustable arc spray nozzle of FIG. 1.
Figure 7:
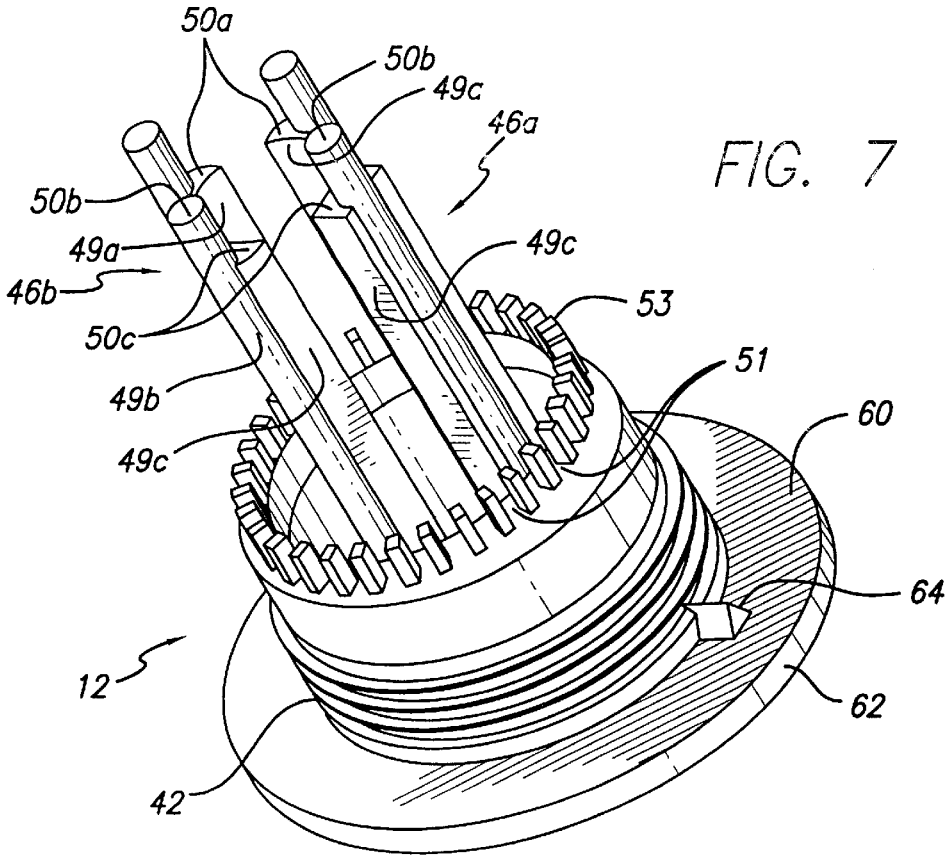
FIG. 7 is a bottom perspective view of the top member of the improved adjustable arc spray nozzle of FIG. 1.
Figure 10A:
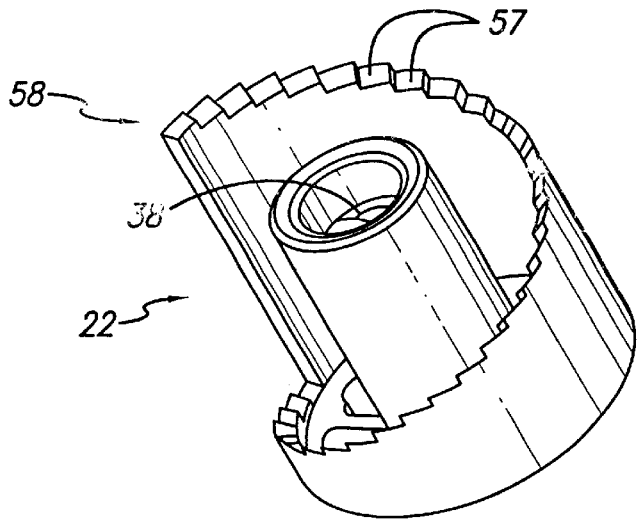
FIGS. 10A and 10B are top and bottom perspective views of the internal helix member of the improved adjustable arc spray nozzle of FIG. 1.
Figure 10B:
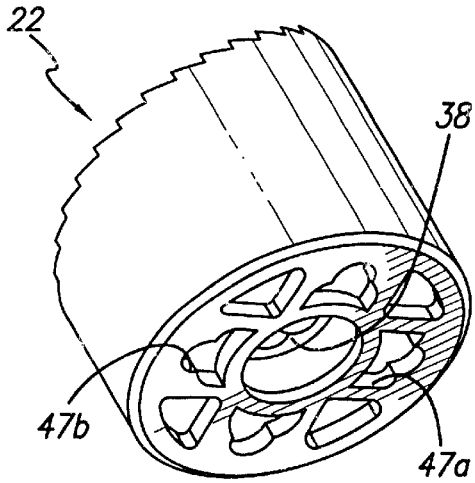
Figure 11:
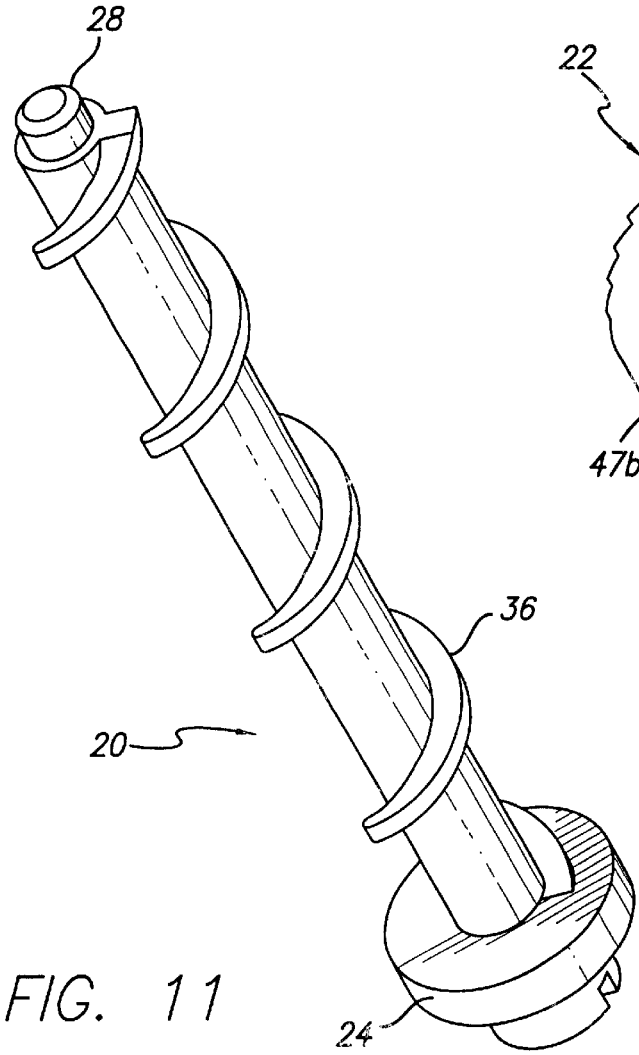
FIG. 11 is a bottom perspective view of the internal flow adjustment screw of the improved adjustable arc spray nozzle of FIG. 1.

Referring to FIGS. 1, 6 and 10, the arc of the nozzle is controlled by the internal helix member 22 located in the internal part of the assembly, which does not rotate. Rather, the internal helix member is fixed and allowed to slide axially along the pegs of the nozzle top member, which prevents the helix from rotating. By rotating the screw that extends through the top member, the helix moves up and down in the internal portion of the assembly. This action is commonly referred to as a "non-rising" stem. The helix has stair steps 57 extending around the full circumference 58 of the internal helix member. The dimensions of the individual stairs can vary in height and width. The top of the helix can be made with no stair steps but in this particular design, the stair design is desirable. For example if the mating slots of the top member and base member form a rectangular orifice of 0.015 by 0.030 with a 0.018 rib between them, causing 32 slots around the circumference, then the internal helix member may have stairs of 0.015 inches tall and rising to 0.480 inches tall in total. As the screw is rotated the helix will move in a downward direction allowing water to flow through the first stair of the lower part of the helix and also flow through only one orifice of 0.015×0.030 at the discharge area of the nozzle, as the screw continues to rotate the helix continues to move in a downward direction. If 32 orifices are around a circumference, this is 11 ¼ degrees per slot. As the helix is moved down another 0.015 the next orifice opens, providing two slots open, resulting in a 22½ degree opening, and so on, orifice by orifice until the desired arc is attained.

Figure 9:
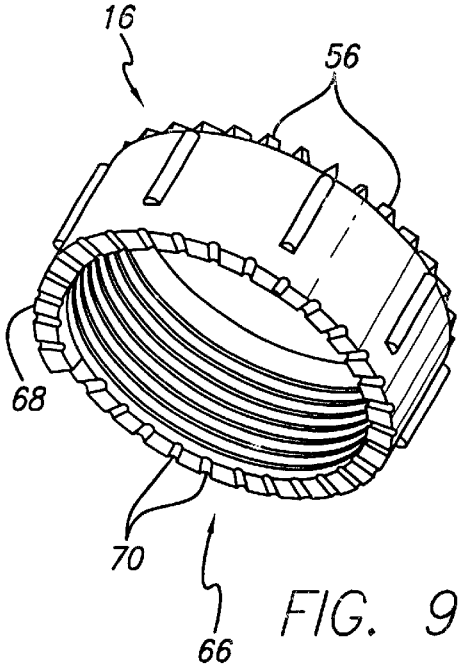
FIG. 9 is a top perspective view of the external upper collar of FIG. 8.

The radius of spray of the nozzle is controlled by the external upper collar. By rotating the external upper collar, so that it moves in a downward direction, the splash plate is thereby moved into the flow of the water from the orifice. The farther the external upper collar is moved down, the more the splash plate interferes with the discharge of the orifice, thereby reducing the radius of the pattern. Referring to FIGS. 7, 8 and 9, the lower surface 60 of the upper portion 62 of the top member has a detent 64, which engages a helix 66 on the upper lip 68 of the external upper collar with grooves 70 for periodic location effecting a ratchet type action, holding the external upper collar in position after being set. The outer portion of the top member can have marks (not shown) that coincide with a mark (not shown) on the upper collar to show preset radius positions.

The flow of the nozzle may also be controlled by the optional external lower collar. Referring to FIGS. 12 and 13, by rotating the lower collar and moving it in an upward direction will start to close the rectangular orifice of 0.015 in height and 0.030 in width, as the lower collar is moved in the upward position the 0.015 height of the orifice is closed to 0.014, for example, thereby reducing the flow of the orifice. The upper surface 72 of the base member has a detent 74, which engages a helix 76 on the lower lip 78 of the external lower collar with grooves 80 for periodic location effecting a "ratchet" type action, holding the external lower collar in position after being set. The outer portion of the base member may have marks (not shown) that coincide with a mark (not shown) on the lower collar to show preset flow.

In an alternate embodiment, the base member may be modified to have a snap-like action ring where the threaded lower collar is located. The ring, which would snap on the base member, can be provided with a flag protruding upwardly to provide a flag ring, and the flag ring can be rotated to direct the stream of water from the orifice on the leading edge of the arc. A fixed flag can also provided at the beginning of the arc mounted to the top member. In this version, the external upper collar and lower collar would be eliminated. The discharge area of the nozzle would be preset for various radiuses and flow by design of the discharge orifice and angle of the discharge.

In another alternate embodiment, the internal helix may have a helical surface that is flat cut at an angle with stair steps, to turn on two streams of water at a time. These streams would be parallel with one another and then add one stream to each side as the internal part moved in the downward direction. Another design would be to incorporate multiple designs on the upper collar for special patterns, such as end strips or side strips, for example, and this could be provided in conjunction with an internal helix or slice design.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. An adjustable arc spray nozzle connectable with a source of pressurized fluid for providing a spray pattern radially disposed about the nozzle, the nozzle comprising:

a top member having a plurality of elongated pegs extending axially from the top member;

a base member connected to the top member, the base member having a threaded outer portion, a discharge orifice being formed in a discharge plane between the top member and the base member, and the top member and base member being connected by the plurality of pegs of the top member;

means mounted on the top member for controlling the radius of the pattern;

an internal helix member for controlling the arc of the spray pattern of the nozzle, the internal helix member being inserted into the top member, the internal helix member having an internal threaded channel, and the internal helix member having a surface defining a plurality of apertures for receiving the plurality of pegs of the top member such that the internal helix member located does not rotate with respect to the top member and the base member, the internal helix member having a helically configured surface extending about the circumference of the internal helix member, whereby as the internal helix member is moved downwardly the arc of the spray pattern of the nozzle increases, and as the internal helix member is moved upwardly the arc of the spray pattern of the nozzle decreases; and an internal flow adjustment screw for controlling the flow of the nozzle, the internal flow adjustment screw extending axially through the internal threaded channel of the internal helix member between the top member and base member, whereby upon rotation of the internal flow adjustment screw the internal helix member moves axially in the internal portion of the assembly to control the flow of water through the discharge orifice of the nozzle proportional to the arc of the spray pattern.

2. The adjustable arc spray nozzle of claim 1, wherein the means mounted on the top member for controlling the radius of the pattern comprises a rotatable external upper collar, the external upper collar being threadedly connected to a threaded outer portion of the top member.

3. The adjustable arc spray nozzle of claim 1, further comprising a rotatable external lower collar for controlling the flow of the nozzle, the rotatable external lower collar being threadedly connected to a threaded outer portion of the base member.

4. The adjustable arc spray nozzle of claim 1, wherein the pegs of the top member include a plurality of stepped sections cooperating with the corresponding apertures in the internal helix member, such that axial movement of the internal helix member controls flow through the discharge orifice proportional to the arc of the spray pattern.

5. The adjustable arc spray nozzle of claim 2, wherein the top member includes an outer portion having marks that coincide with a corresponding mark on the external upper collar to show preset radius positions.

6. The adjustable arc spray nozzle of claim 1, wherein the top member and the base member have surfaces together defining a plurality of mating slots at the discharge plane.

7. The adjustable arc spray nozzle of claim 3, wherein the outer portion of the base member includes a plurality of marks to coincide with a corresponding mark on the external lower collar to indicate a preset flow.

8. The adjustable arc spray nozzle of claim 2, wherein the external upper collar has a bottom side with a splash plate portion on the bottom side that is slightly above the discharge plane.

9. The adjustable arc spray nozzle of claim 8, wherein by movement of the external upper collar in a downward direction the splash plate interferes with the discharge plane, causing a breakup action of the discharge of water from the discharge orifice.

10. The adjustable arc spray nozzle of claim 2, wherein the radius of the pattern can be reduced by downward movement of the external upper collar, and the radius of the pattern can be increased by upward movement of the external upper collar.

11. The adjustable arc spray nozzle of claim 2, wherein a lower portion of the top member includes a detent which engages a helical surface on an upper lip portion of the external upper collar, the helical surface on the upper lip portion of the external upper collar having a plurality of grooves permitting periodic location of the detent of the top member, thereby effecting a ratchet type action and holding the external upper collar in position after being set.

12. The adjustable arc spray nozzle of claim 3, wherein the external lower collar can be rotated moving in an upward direction that will cover the discharge of the discharge orifice or slot thereby controlling the amount water to be discharged.

13. The adjustable arc spray nozzle of claim 3, wherein an upper surface of the base member includes a detent which engages a helical surface on a lower portion of the external lower collar, the helical surface on the lower portion of the external lower collar including a plurality of grooves permitting periodic location of the detent of the base member, thereby effecting a ratchet type action and holding the external lower collar in position after being set.

14. The adjustable arc spray nozzle of claim 1, wherein the internal helix member has a plurality of incremental steps extending about the circumference of the internal helix member, whereby as the internal helix member is moved downwardly each incremental step a corresponding slot between the top member and the base member is opened, and as the internal helix member is moved upwardly each incremental step a corresponding slot between the top member and the base member is closed, to control the arc of the spray pattern of the nozzle.

15. The adjustable arc spray nozzle of claim 1, wherein the internal flow adjustment screw has an upper end with a flange received in a corresponding slot in the top member, and the internal flow adjustment screw has a bottom end captured in the base member, such that the internal flow adjustment screw controls the size of the discharge orifice when the top member and the base member are assembled.

16. An adjustable arc spray nozzle connectable with a source of pressurized fluid for providing a spray pattern radially disposed about the nozzle, the nozzle comprising:

a top member having a threaded outer portion and a plurality of elongated pegs extending axially from the top member;

a base member connected to the top member, the base member having a threaded outer portion, a discharge orifice being formed in a discharge plane between the top member and the base member;

a rotatable external upper collar for controlling the radius of the pattern, the external upper collar being threadedly connected to the threaded outer portion of the top member;

a rotatable external lower collar for controlling the flow of the nozzle, the rotatable external lower collar being threadedly connected to the threaded outer portion of the base;

an internal helix member for controlling the arc of the spray pattern of the nozzle, the internal helix member being inserted into the top member, the internal helix member having an internal threaded channel, and the internal helix member having a surface defining a plurality of apertures receiving the plurality of pegs of the top member such that the internal helix member located does not rotate with respect to the top member and the base member, the internal helix member having a helically configured surface extending about the circumference of the internal helix member, whereby as the internal helix member is moved downwardly the arc of the spray pattern of the nozzle increases, and as the internal helix member is moved upwardly the arc of the spray pattern of the nozzle decreases; and an internal flow adjustment screw for controlling the flow of the nozzle, the internal flow adjustment screw extending axially through the internal threaded channel of the internal helix member between the top member and base member, whereby upon rotation of the internal flow adjustment screw the internal helix member moves axially in the internal portion of the assembly to control the flow of water through the discharge orifice of the nozzle proportional to the arc of the spray pattern.

17. The adjustable arc spray nozzle of claim 16, wherein the pegs of the top member include a plurality of stepped sections cooperating with the corresponding apertures in the internal helix member, such that axial movement of the internal helix member controls flow through the discharge orifice proportional to the arc of the spray pattern.

18. The adjustable arc spray nozzle of claim 16, wherein the top member includes an outer portion having marks that coincide with a corresponding mark on the upper collar to show preset radius positions.

19. The adjustable arc spray nozzle of claim 16, wherein the top member and the base member have surfaces together defining a plurality of mating slots at the discharge plane.

20. The adjustable arc spray nozzle of claim 16, wherein the outer portion of the base member includes a plurality of marks to coincide with a corresponding mark on the lower collar to indicate a preset flow.

21. The adjustable arc spray nozzle of claim 16, wherein the external upper collar has a bottom side with a splash plate portion on the bottom side that is slightly above the discharge plane.

22. The adjustable arc spray nozzle of claim 21, wherein by movement of the external upper collar in a downward direction the splash plate portion interferes with the discharge plane, causing a breakup action of the discharge of water from the discharge orifice.

23. The adjustable arc spray nozzle of claim 16, wherein the radius of the pattern can be reduced by downward movement of the external upper collar, and the radius of the pattern can be increased by upward movement of the external upper collar.

24. The adjustable arc spray nozzle of claim 16, wherein a lower portion of the top member includes a detent which engages a helical surface on an upper lip portion of the external upper collar, the helical surface on the upper lip portion of the external upper collar having a plurality of grooves permitting periodic location of the detent of the top member, thereby effecting a ratchet type action and holding the external upper collar in position after being set.

25. The adjustable arc spray nozzle of claim 16, wherein the external lower collar can be rotated moving in an upward direction that will cover the discharge of the discharge orifice or slot thereby controlling the amount water to be discharged.

26. The adjustable arc spray nozzle of claim 16, wherein an upper surface of the base member includes a detent which engages a helical surface on a lower portion of the external lower collar, the helical surface on the lower portion of the external lower collar including a plurality of grooves permitting periodic location of the detent of the base member, thereby effecting a ratchet type action and holding the external lower collar in position after being set.

27. The adjustable arc spray nozzle of claim 16, wherein the internal helix member has a plurality of incremental steps extending about the circumference of the internal helix member, whereby as the internal helix member is moved downwardly each incremental step a corresponding slot between the top member and the base member is opened, and as the internal helix member is moved upwardly each incremental step a corresponding slot between the top member and the base member is closed, to control the arc of the spray pattern of the nozzle.

28. The adjustable arc spray nozzle of claim 16, wherein the internal flow adjustment screw has an upper end with a flange received in a corresponding slot in the top member, and the internal flow adjustment screw has a bottom end captured in the base member, and the pegs include a plurality of stepped sections cooperating with the corresponding apertures in the internal helix member, such that the internal flow adjustment screw controls the size of the discharge orifice, and axial movement of the internal helix member controls flow through the discharge orifice proportional to the arc of the spray pattern, when the top member and the base member are assembled.

* * * * *